US010222167B2

(12) United States Patent
Zhu

(10) Patent No.: US 10,222,167 B2
(45) Date of Patent: Mar. 5, 2019

(54) THREE-STAGE AIR PUMP ASSEMBLY FOR PNEUMATIC AIR GUN

(71) Applicant: Zhongshan New Swan Technology Co., Ltd., Zhongshan (CN)

(72) Inventor: Zuopeng Zhu, Zhongshan (CN)

(73) Assignee: ZHONGSHAN NEW SWAN TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 15/825,051

(22) Filed: Nov. 28, 2017

(65) Prior Publication Data

US 2018/0080735 A1 Mar. 22, 2018

Related U.S. Application Data

(63) Continuation-in-part of application No. PCT/CN2016/077185, filed on Mar. 24, 2016.

(30) Foreign Application Priority Data

Jan. 15, 2016 (CN) ..... 2016 2 0040468 U

(51) Int. Cl.

| | |
|---|---|
| ***F41B 11/73*** | (2013.01) |
| ***F41B 11/681*** | (2013.01) |
| ***F41B 11/62*** | (2013.01) |
| ***F41B 11/723*** | (2013.01) |
| ***F41B 11/683*** | (2013.01) |
| *F41B 11/66* | (2013.01) |

(52) U.S. Cl.

CPC ..... *F41B 11/62* (2013.01); *F41B 11/683* (2013.01); *F41B 11/723* (2013.01); *F41B 11/73* (2013.01); *F41B 11/66* (2013.01)

(58) Field of Classification Search

CPC ..... F41B 11/00; F41B 11/64; F41B 11/641; F41B 11/648; F41B 11/681; F41B 11/682; F41B 11/683; F41B 11/72; F41B 11/73

USPC ..... 124/63, 65, 69, 70

See application file for complete search history.

(56) References Cited

U.S. PATENT DOCUMENTS 1,240,989 A * 9/1917 Lefever ..... F41B 11/72 124/69
2,299,073 A * 10/1942 Beasley ..... F41B 11/683 124/69
3,308,803 A * 3/1967 Walther ..... F41B 11/68 124/37

(Continued)

*Primary Examiner* — Derrick R Morgan
(74) *Attorney, Agent, or Firm* — Matthias Scholl, PC; Matthias Scholl

(57) ABSTRACT

A three-stage air pump assembly for a pneumatic air gun. The three-stage air pump assembly includes an air compression assembly and an energy storage assembly disposed on a gun support of the pneumatic air gun. The energy storage assembly includes a three-stage air pump and a main check valve disposed at the end of the air pump. The three-stage air pump includes a front fixed sheath, a rear fixed sheath, a front movable sheath, a rear movable sheath, a first tube, a second tube, a third tube, and a piston rod. The diameters of the first tube, the second tube and the third tube are successively reduced. An intake sleeve on the main check valve is sealed and fixedly connected in the rear fixed sheath. Front and rear ends of the first tube are sheathed on the front fixed sheath and the rear fixed sheath, respectively.

2 Claims, 6 Drawing Sheets

(56) References Cited

U.S. PATENT DOCUMENTS

| | | | | |
|---|---|---|---|---|
| 5,224,465 | A * | 7/1993 | Milliman | F41B 11/723 124/69 |
| 5,570,676 | A * | 11/1996 | Gore | F41B 11/642 124/56 |
| 6,343,598 | B1 * | 2/2002 | Pshenychny | F41B 11/683 124/60 |
| 6,581,585 | B2 * | 6/2003 | Nibecker, Jr. | F41B 11/683 124/69 |
| 9,157,695 | B1 * | 10/2015 | Gore | F41B 11/642 |
| 9,404,707 | B2 * | 8/2016 | Gore | F41B 11/647 |
| 2003/0094167 | A1 * | 5/2003 | Nibecker, Jr. | F41B 11/683 124/64 |
| 2012/0125305 | A1 * | 5/2012 | Zafer | F41B 11/683 124/65 |
| 2015/0053194 | A1 * | 2/2015 | Li | F41B 11/683 124/69 |
| 2018/0045484 | A1 * | 2/2018 | Zhu | F41B 11/50 |
| 2018/0058801 | A1 * | 3/2018 | Gore | F16F 9/02 |
| 2018/0149445 | A1 * | 5/2018 | Lamboy | F41B 11/683 |

* cited by examiner

THREE-STAGE AIR PUMP ASSEMBLY FOR PNEUMATIC AIR GUN

CROSS-REFERENCE TO RELATED APPLICATIONS

This application is a continuation-in-part of International Patent Application No. PCT/CN2016/077185 with an international filing date of Mar. 24, 2016, designating the United States, now pending, and further claims foreign priority to Chinese Patent Application No. 201620040468.8 filed Jan. 15, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The present disclosure relates to a three-stage air pump assembly for a pneumatic air gun.

Description of the Related Art

Typically, pneumatic air guns include a single-stage air pump, leading to relatively low air pressure and air input.

SUMMARY OF THE INVENTION

It is one objective of the present disclosure to provide a three-stage air pump assembly for a pneumatic air gun. The three-stage air pump assembly can significantly improve the performance of the pneumatic air gun through boosting the air pressure and increasing the air volume in the pneumatic air gun.

To achieve the above objective, in accordance with one embodiment of the present disclosure, there is provided a three-stage air pump assembly for a pneumatic air gun, comprising an air compression assembly and an energy storage assembly disposed on a gun support; the energy storage assembly comprises an air pump and a main check valve disposed at an end of the air pump. The air pump is a three-stage air pump. The three-stage air pump comprises a front fixed sheath, a rear fixed sheath, a front movable sheath, a rear movable sheath, a first tube, a second tube, a third tube, and a piston rod, where diameters of the first tube, the second tube and the third tube are successively reduced. An intake sleeve on the main check valve is sealed and fixedly connected in the rear fixed sheath.

Front and rear ends of the first tube are sheathed tightly on the front fixed sheath and the rear fixed sheath respectively. The front fixed sheath and the rear fixed sheath are both fixedly connected to the gun body support through a connection portion that extends out of the first tube. An O-ring of the first tube seals between an inner wall of a rear end of the first tube between an outer wall of the rear fixed sheath.

The front movable sheath is positioned at a front portion of the first tube. A steel ball is provided on an outer circumference of the front movable sheath. The front movable sheath is slidably mated to the inner wall of the first tube through the steel ball. The rear movable sheath is positioned at a rear portion of the first tube. A first-stage check valve is provided between the outer wall of the rear movable sheath and the inner wall of the first tube. The first-stage check valve, which is opened upon air admission and closed upon air compression, is fixed to the outer wall of the rear movable sheath.

The second tube is coaxially disposed in the first tube. The front and rear ends of the second tube is tightly sheathed in the front movable sheath and rear movable sheath respectively. The third tube is coaxially disposed in the second tube. The rear end of the third tube is sealed and fixedly connected in an intake sleeve on the main check valve. A second-stage check valve is provided between the inner wall of the rear movable sheath and the outer wall of the third tube. The second-stage check valve, which is closed upon air admission and opened upon air compression, is fixed to the inner wall of the rear movable sheath.

The piston rod is positioned in the third tube. One end of the piston rod extends out of the third tube and is hinged to the front movable sheath through a pin shaft of the front movable sheath. A third-stage check valve is provided between the other end of the piston rod and the inner wall of the third tube. The third-stage check valve, which is opened upon air admission and closed upon air compression, is fixed to a piston head of the piston rod.

The air compression assembly comprises a connection bar and a compression bar. One end of the connection bar is rotatably connected to the front movable sheath through a pin shaft of the connection bar. The compression bar is rotatably connected to the front fixed sheath through a front pin shaft of the compression bar. The other end of the connection bar is rotatably connected to a middle portion of the compression bar through a rear pin shaft of the compression bar.

In a class of this embodiment, the compression bar comprises a handle.

Advantages of the three-stage air pump assembly for a pneumatic air gun according to embodiments of the invention are as follows.

1. The three-stage air pump principle is adopted in the present disclosure, that is, a multi-stage sleeve is used to form three air chambers to achieve a step-by-step boost to obtain a high pressure and a high air volume required by the functional performance of a pneumatic air gun. A lever and a handle are used in combination to reduce the force necessary for air compression. By using a three-stage air pump assembly in a gun and using the leverage principle for air compression, the balance between the pressure and the compressed air volume and the compression force applied to the bar can be improved, thereby improving the performance of the gun.
2. The front movable sheath is slidably mated to the inner wall of the first tube through a steel ball, thereby resulting in a stable air admission and compression motion.

DETAILED DESCRIPTION OF THE EMBODIMENTS

Figure 1:
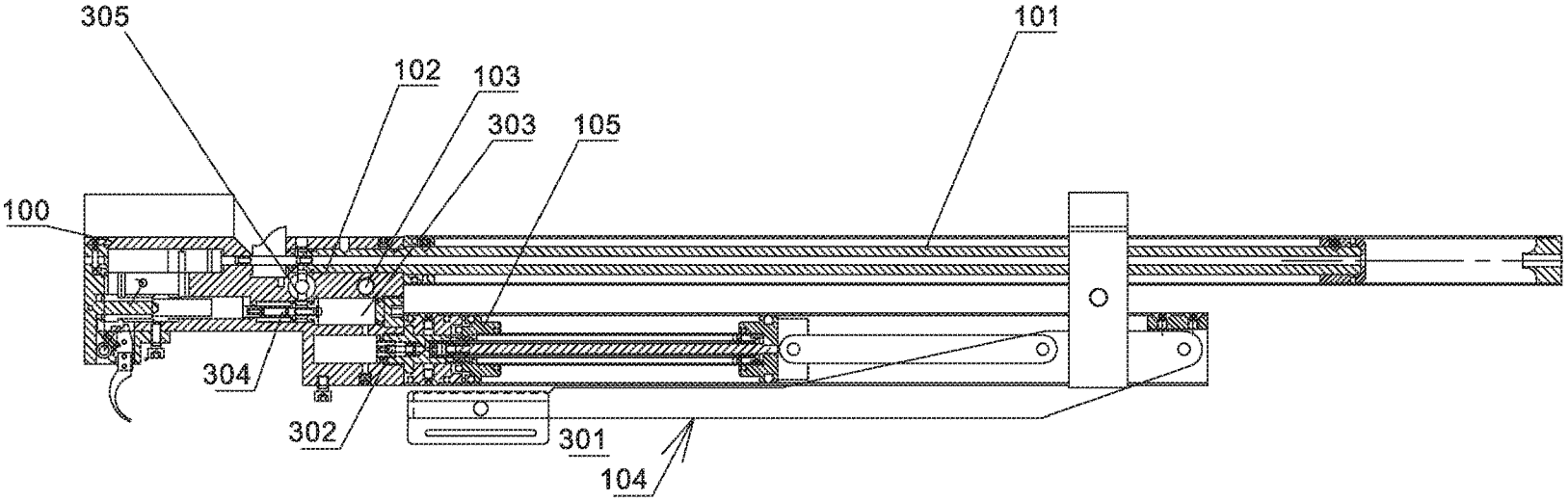
FIG. 1 is a schematic diagram of a three-stage air pump assembly for a pneumatic air gun in accordance with one embodiment of the present disclosure.
Figure 2:
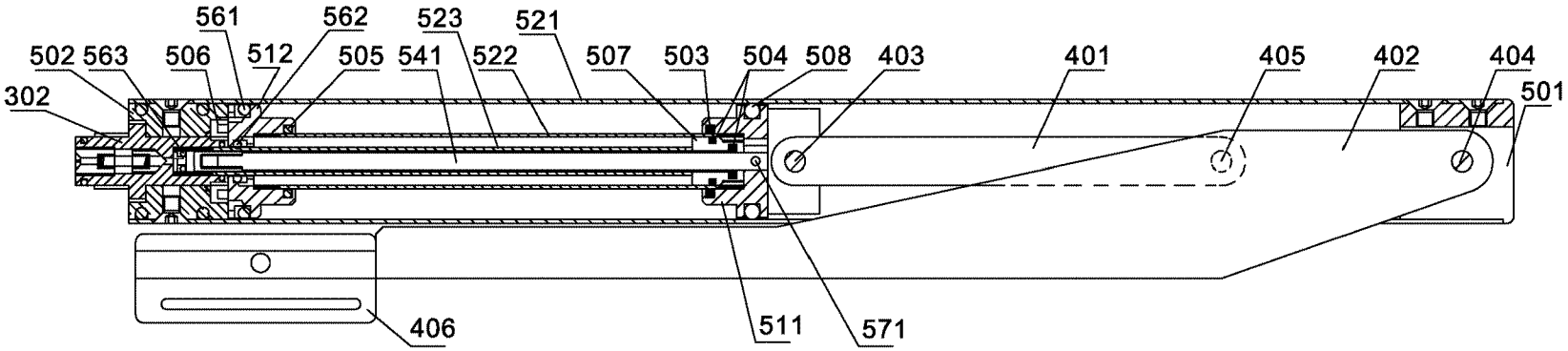
FIG. 2 is a cross-sectional view of an air compression assembly and an energy storage assembly in accordance with one embodiment of the present disclosure.
Figure 3:
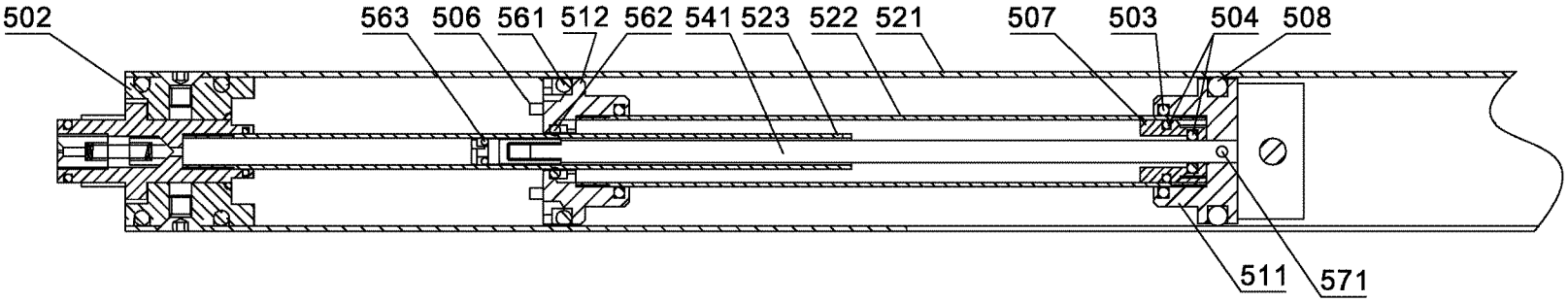
FIG. 3 is a cross-sectional view of an air compression assembly in an intermediate state between air admission and compression in accordance with one embodiment of the present disclosure.
Figure 4:
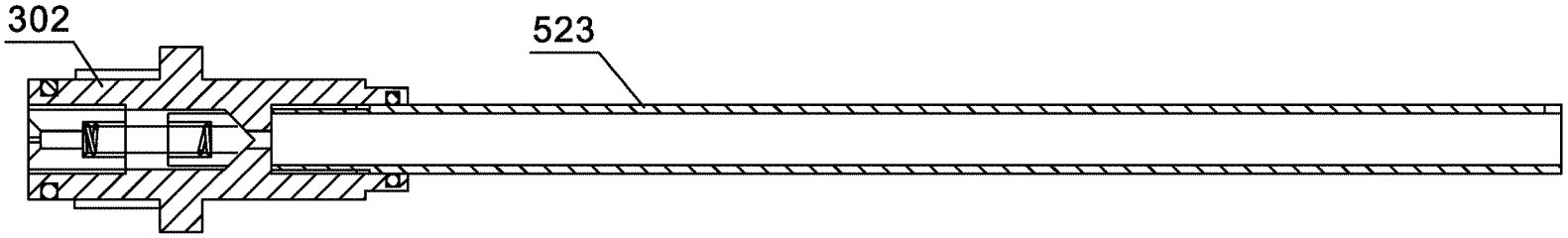
FIG. 4 is a cross-sectional view of a third tube and a main check valve in an assembled state in accordance with one embodiment of the present disclosure.
Figure 5:
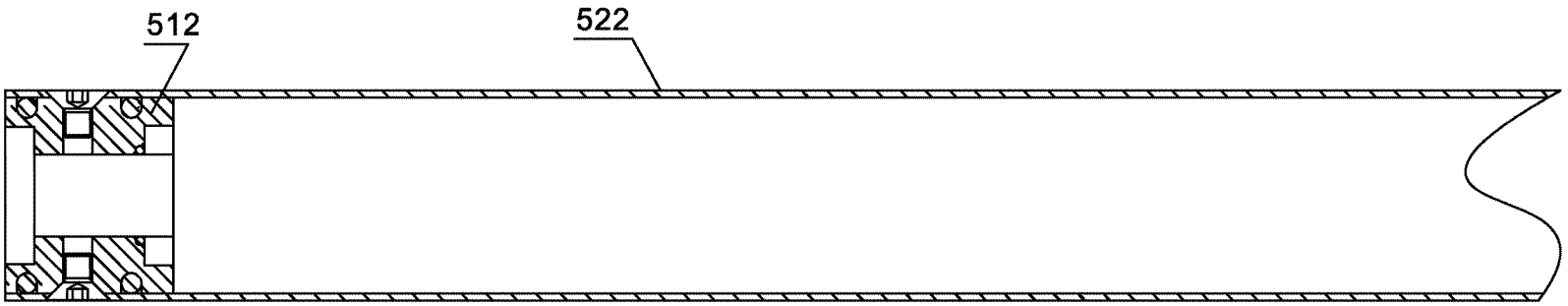
FIG. 5 is a cross-sectional view of a first tube and a rear fixed sheath in accordance with one embodiment of the present disclosure.
Figure 6:
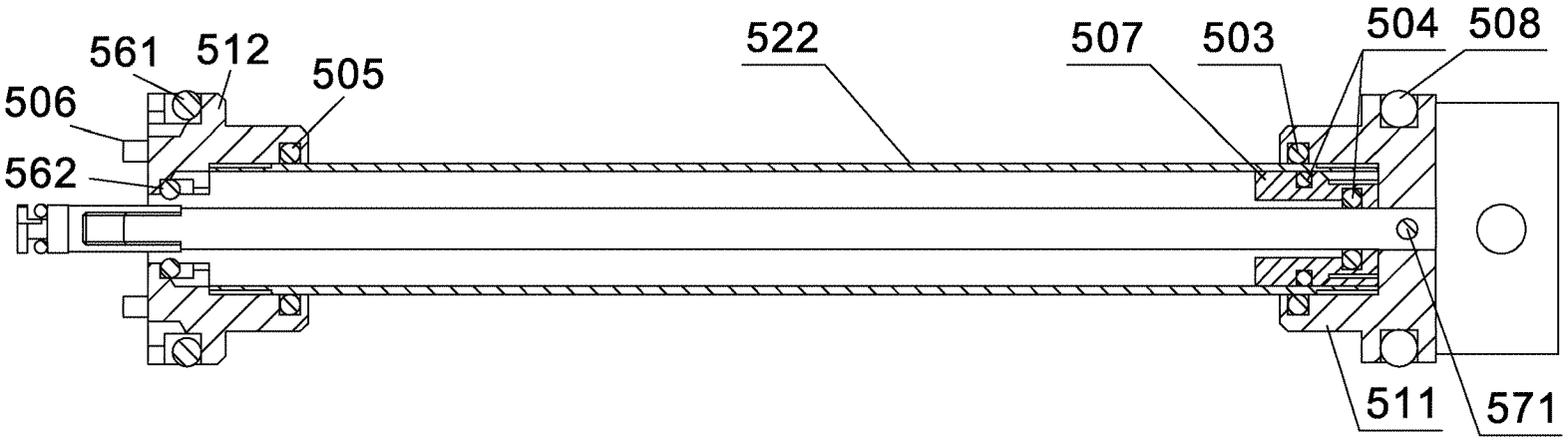
FIG. 6 is a cross-sectional view of a second tube, a front movable sheath, and a rear movable sheath in accordance with one embodiment of the present disclosure.

As shown in FIGS. 1-6, a three-stage air pump assembly for a pneumatic air gun comprises an air compression assembly 104 and an energy storage assembly 105 disposed on a gun support. The air compression assembly 104 is connected to the energy storage assembly 105, and the energy storage assembly 105 is connected to the valve body 102.

The energy storage assembly 105 comprises an air pump 301 and a main check valve 302 disposed at an end of the air pump 301. The valve body 102 comprises an air release passage 303 adapted to connect the main check valve 302 and the barrel 101. The air release passage 303 is provided with an air release valve 304 capable of controlling the opening and closing of an air channel. The air release passage 303 between the air release valve 304 and the barrel 101 is further provided with a speed-regulation valve 305 for regulating an air flow. The air release valve 304 is provided with a slider for controlling the opening or closing of the air release passage 303. The slider is positioned at the end of the striking travel of the hammer.

When the air compression assembly 104 compresses air to the main check valve 302, the high pressure air presses and opens the main check valve 302 and is enclosed in an inlet port of the air release valve 304. When the triggering assembly is pulled, the hammer strikes the slider at the end of its travel to open the air release valve 304. Then high pressure air enters the barrel 101 via the air release valve 304 and the speed-regulation valve 305 to propel the pellet.

In this embodiment, the air pump 301 is a three-stage air pump. The three-stage pump 301 comprises a front fixed sheath 501, a rear fixed sheath 502, a front movable sheath 511, a rear movable sheath 512, a first tube 521, a second tube 522, a third tube 523, and a piston rod 541, where diameters of the first tube, the second tube and the third tube are successively reduced. An intake sleeve on the main check valve 302 is sealed and fixedly connected into the rear fixed sheath 502. Front and rear ends of the first tube 521 are sheathed tightly on the front fixed sheath 501 and the rear fixed sheath 502 respectively. The front fixed sheath 501 and the rear fixed sheath 502 are both fixed to the gun body support 100 through a connection portion that extends out of the first tube 521. An O-ring of the first tube seals between an inner wall of the first tube 521 at its rear end and an outer wall of the rear fixed sheath 502.

The front movable sheath 511 is positioned in a front portion of the first tube 521. A steel ball 508 is provided at an outer circumference of the front movable sheath 511. The front movable sheath 511 is slidably mated to an inner wall of the first tube 521 through the steel ball 508. The rear movable sheath 512 is positioned in a rear portion of the first tube 521. A first-stage check valve 561 is provided between the outer wall of the rear movable sheath 512 and the inner wall of the first tube 521. The first-stage check valve 561, which is opened upon air admission and closed upon air compression, is fixed to an outer wall of the rear movable sheath 512.

The second tube 522 is coaxially disposed in the first tube 521. The front and rear ends of the second tube 522 are sheathed tightly in the front movable sheath 511 and the rear movable sheath 512 respectively. The rear movable sheath 512 is tightened to the second tube 522 through a nut 506. A rear joint bushing in the form of an O-ring 505 is provided between the rear movable sheath 512 and the second tube 522. A joint bushing 507 is provided in the second tube 522 and the inner wall of the front movable sheath 511 and is sheathed on the front end of the second tube. An inner joint bushing in the form of an O-ring 504 and an outer joint bushing in the form of an O-ring 503 are provided respectively between the inner wall of the second tube 522 and an outer wall of the joint bushing 507 and between the outer wall of the second tube 522 and the inner wall of the front movable sheath 511. The third tube 523 is disposed coaxially in the second tube 522. The third tube 523 is sealed at its rear end and is fixedly connected in the intake sleeve on the main check valve 302. A second-stage check valve 562 is provided between the inner wall of the rear movable sheath 512 and the outer wall of the third tube 523. The second-stage check valve 562, which is closed upon air admission and opened upon air compression, is fixed to the inner wall of the rear movable sheath 512.

The piston rod 541 is positioned in the third tube 523. One end of the piston rod 541 extends out of the third tube 523 and is hinged to the front movable sheath 511 through a pin shaft 571 of the front movable sheath. A third-stage check valve 563 is provided between the other end of the piston rod 541 and the inner wall of the third tube 523. The third-stage check valve 563, which is opened upon air admission and closed upon air compression, is fixed to the piston head of the piston rod 541.

In this embodiment, the air compression assembly 104 comprises a connection bar 401 and a compression bar 402. One end of the connection bar 401 is rotatably connected to the front movable sheath 511 through a pin shaft 403 of the connection bar. The compression bar 402 is rotatably connected to the front fixed sheath 501 through the front pin shaft 404 of the compression bar. The other end of the connection bar 401 is rotatably connected to a middle portion of the compression bar 402 through a rear pin shaft 405 of the compression bar. The compression bar 402 is provided with a handle 406. For air compression, the air compression assembly 104 drives the piston rod 541 to perform air compression. The air admission and compression process of the piston rod 541 is as follows.

In a first step for air admission, the connection bar 401 drives the piston rod 541 to move forward for air admission. In this process, the first-stage check valve 561 opens under an external air pressure to allow air into the first tube 521. In this process, the second-stage check valve 562 closes under the air pressure between the second tube 522 and the third tube 523. In this process, the third-stage check valve 563 opens under the air pressure between the second tube 522 and the third tube 523 to allow the air into the third tube 523.

In a second step for air compression, the connection bar 401 drives the piston rod 541 to move backward for air compression. In this process, the first-stage check valve 561 closes under the air pressure enclosed in the first tube 521 to be isolated from the external environment. In this process, the second-stage check valve 562 opens under the air pressure between the second tube 522 and the third tube 523 to allow the first-stage compressed air in the first tube 521 to enter in between the second tube 522 and the third tube 523 for preparation of a second-stage air compression for the next air admission. In this process, the third-stage check valve 563 closes under the air pressure enclosed in the third tube 523. The compressed air enters the air release passage 303 via the main check valve 302 and is enclosed in the air release passage 303 between the main check valve 302 and the air release valve 304.

In a third step, the operation in the first and second steps are repeated to perform repeated air compression until the pressure gauge 103 has reached the required pressure value and then the gun is ready to shoot.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An air pump assembly for a pneumatic air gun, the air pump assembly comprising:

an air compression assembly; and an energy storage assembly, the energy storage assembly comprising an air pump and a main check valve disposed at an end of the air pump, the air pump comprising a front fixed sheath, a rear fixed sheath, a front movable sheath, a rear movable sheath, a first tube, a second tube, a third tube, and a piston rod; wherein:

diameters of the first tube, the second tube, and the third tube are successively reduced;

front and rear ends of the first tube are sheathed on the front fixed sheath and the rear fixed sheath, respectively;

an O-ring of the first tube seals between an inner wall of the first tube and an outer wall of the rear fixed sheath;

the front movable sheath is positioned at a front portion of the first tube;

a plurality of steel balls are rotatably disposed in a groove on an outer circumference of the front movable sheath;

the plurality of steel balls are in rotatable contact with an inner wall of the first tube, thereby allowing for slide of the front movable sheath on the inner wall of the first tube;

the rear movable sheath is positioned at a rear portion of the first tube;

a first-stage check valve is provided between an outer wall of the rear movable sheath and the inner wall of the first tube;

the first-stage check valve is fixed to the outer wall of the rear movable sheath;

the second tube is coaxially disposed in the first tube;

the front and rear ends of the second tube is sheathed in the front movable sheath and rear movable sheath, respectively;

the third tube is coaxially disposed in the second tube;

a second-stage check valve is provided between the inner wall of the rear movable sheath and the outer wall of the third tube;

the second-stage check valve is fixed to the inner wall of the rear movable sheath;

the piston rod is positioned in the third tube;

one end of the piston rod extends out of the third tube and is hinged to the front movable sheath through a pin shaft of the front movable sheath;

a third-stage check valve is provided between the other end of the piston rod and the inner wall of the third tube;

the third-stage check valve is fixed to a piston head of the piston rod;

the air compression assembly comprises a connection bar and a compression bar;

one end of the connection bar is rotatably connected to the front movable sheath through a pin shaft of the connection bar;

the compression bar is rotatably connected to the front fixed sheath through a front pin shaft of the compression bar; and the other end of the connection bar is rotatably connected to a middle portion of the compression bar through a rear pin shaft of the compression bar.

2. The air pump assembly of claim 1, wherein the compression bar comprises a handle.

* * * * *